US007170403B2

(12) United States Patent
Noguchi

(10) Patent No.: US 7,170,403 B2
(45) Date of Patent: Jan. 30, 2007

(54) TAMPER SWITCH STRUCTURE AND SECURITY SENSOR INCLUDING THE TAMPER SWITCH STRUCTURE

(75) Inventor: Michinori Noguchi, Otsu (JP)

(73) Assignee: Optex Co., Ltd., Shiga (JP)

( * ) Notice: Subject to any disclaimer, the term of this patent is extended or adjusted under 35 U.S.C. 154(b) by 125 days.

(21) Appl. No.: 11/088,917

(22) Filed: Mar. 25, 2005

(65) Prior Publication Data

US 2005/0219046 A1 Oct. 6, 2005

(30) Foreign Application Priority Data

Mar. 25, 2004 (JP) ..... 2004-088999

(51) Int. Cl.
*G08B 29/00* (2006.01)

(52) U.S. Cl. ..... 340/507; 340/568.1; 340/521; 340/539.31

(58) Field of Classification Search ..... 340/507, 340/521, 568.1, 539.31, 566, 567, 571, 540, 340/286.01, 286.02; 250/342, 353; 200/61.93, 200/61.03

See application file for complete search history.

(56) References Cited

U.S. PATENT DOCUMENTS 4,092,641 A * 5/1978 Bellinghausen et al. .... 340/521
5,753,983 A * 5/1998 Dickie et al. ..... 307/141.4
5,764,729 A * 6/1998 Black et al. ..... 379/44
6,301,501 B1 * 10/2001 Cronin et al. ..... 607/5
6,956,479 B2 * 10/2005 Kelsch et al. ..... 340/568.1

FOREIGN PATENT DOCUMENTS

| | | |
|---|---|---|
| EP | 0568137 | 4/1992 |
| GB | 2254944 | 10/1992 |
| GB | 2359649 | 8/2001 |

* cited by examiner

*Primary Examiner*—Anh V. La
(74) *Attorney, Agent, or Firm*—Wenderoth, Lind & Ponack, L.L.P.

(57) ABSTRACT

A tamper switch body is disposed in a housing of a PIR sensor. A tamper opening is formed at a position opposite a switch actuating member of the tamper switch body in a base plate of the PIR sensor. An elastic switch member is mounted in the tamper opening. The elastic switch member includes a pressure-receiving projection portion abutting a mounting plate, and depresses the switch actuating member through elastic deformation of the pressure-receiving projection portion by receiving a pushing force from the mounting plate in a state in which the PIR sensor is fixed to a wall surface. The elastic switch member seals the inside of the housing by closing the tamper opening, thus preventing a flood into the housing of the PIR sensor.

13 Claims, 8 Drawing Sheets

TAMPER SWITCH STRUCTURE AND SECURITY SENSOR INCLUDING THE TAMPER SWITCH STRUCTURE

BACKGROUND OF THE INVENTION

1. Field of the Invention

This application claims priority under 35 U.S.C. § 119(a) on Patent Application No. 2004-88999 filed in Japan on Mar. 25, 2004, the entire contents of which are hereby incorporated by reference.

The present invention relates to tamper switch structures used for security sensors such as passive infrared sensors (PIR sensors) and active infrared sensors (AIR sensors), and to security sensors including such tamper switch structures. In particular, the invention relates to measures for adding a tampering detection function to security sensors of outdoor installation type (the type installed at locations where water such as rainwater pours over) with a simple configuration.

2. Description of the Related Art

Conventionally, the PIR sensor, which is one type of security sensors, contains a PIR element, and is so configured that this PIR element detects an intruder from the difference between the temperature of the intruder's body and the ambient temperature by receiving infrared radiation from the human body within a detection area.

On the other hand, in an attempt to illegally intrude into a room in which this type of sensor is installed, the sensor body may be removed from the mounting plate in non-alert operation, and be mounted on the mounting plate again after the sensor is rendered unable to detect a human body by corrupting it (tampering) such as attaching paper tape or plastic tape or spraying transparent paint that does not transmit infrared radiation onto the incident path of infrared radiation to the PIR element within the sensor body. In this case, the sensor will not be able to detect illegal intruders in alert operation. Also, the sensor body may be removed from the mounting plate in non-alert operation and stolen, so that the detection of illegal intruders is disabled.

Therefore, intruder detection systems having this type of sensor include a tampering detection function that operates also in non-alert operation, and are configured so as to output a tampering detection signal (hereinafter, referred to as "trouble signal") when the sensor body is removed from the mounting plate.

In the case of providing such a tampering detection function, it is necessary to provide a large number of wiring, namely, power supply wiring, transmission wiring for a human body detection signal for sending a detection signal at the time of detecting a human body and wiring for tampering detection, between the mounting plate on which the sensor body is mounted and a control panel that is placed at a different location, resulting in a poor operability of the intruder detection systems.

In view of that the power supply wiring is disconnected when the above-described stealing is carried out, it is conceivable, as one measure to solve this problem, to adopt a configuration that allows the detection of disconnection of the power supply wiring, thereby making it possible to detect the stealing, without requiring the wiring for tampering detection.

Conventional security sensors such as the PIR sensor have required relatively large power consumption, and thus have required the above-described power supply wiring. However, in recent years, the development of sensing elements such as the PIR element has advanced to reduce the power consumption significantly, making it possible to drive the security sensors with their internal batteries for a long period of time, without requiring power supply from the power supply wiring.

The fact that the power supply wiring becomes unnecessary in this way can lead to that it is impossible to realize the above-described configuration, such as that "allows the detection of disconnection of the power supply wiring, thereby making it possible to detect the stealing". In other words, as the power supply wiring has become unused due to the development of sensing elements, it has become necessary to realize a configuration in which the sensor body includes the tampering detection function.

In order to realize this, JP H5-54269A (hereinafter, referred to as Patent reference 1) discloses that an opening is formed on the rear surface of a sensor casing, and that the actuating piece of a tamper switch housed inside the sensor is projected outside from the opening. That is, in a state in which the sensor is normally mounted on a wall surface, the actuating piece is depressed by the wall surface and no trouble signal is transmitted. When the sensor has been removed from the wall surface or when the sensor body has been removed from the mounting plate, the depressing of the actuating piece is released, and as a result, the trouble signal is transmitted.

As described above, although the type of security sensors to which the power supply wiring is connected can detect the above-described stealing by allowing the detection of disconnection of the power supply wiring, they cannot detect the tampering such as attaching paper tape or plastic tape or spraying transparent paint that does not transmit infrared radiation onto the incident path of infrared radiation without disconnecting the power supply wiring. Therefore, it is preferable that the sensor body includes the tampering detection function not only in wireless security sensors, which require no power supply wiring, but also in security sensors of the type to which the power supply wiring is connected (wired security sensors).

The security sensor including the tamper switch, disclosed in Patent reference 1 above, has been proposed for the indoor installation type. This is evident from the fact that no consideration is given at all to waterproof for the opening from which the actuating piece of the above-described tamper switch is projected.

Therefore, in the case of using this type of security sensor as the outdoor installation type, the tamper switch structure disclosed in Patent reference 1 above cannot be used as it is. The reason is that, since rainwater or the like may poured over security sensors installed outdoor, rainwater or the like may enter the structure disclosed in Patent reference 1 above from the opening provided for projecting the actuating piece of the tamper switch, causing a failure of the sensor.

The present invention has been made in view of the above-described problems, and it is an object thereof to provide a tamper switch structure for providing a sensor body with a tampering detection function that can provide an excellent tampering detection function while reliably preventing a flood from outside, and a security sensor including such a tamper switch structure.

SUMMARY OF THE INVENTION

Summary of the Invention

In a solving means according to the present invention that was made in order to achieve the above-described objects, between an actuating piece (switch actuating member) of a tamper switch and a wall surface or the like that causes a depressing force on the actuating piece, a member (elastic switch member) for transferring the depressing force on the actuating piece is disposed, and an opening formed to mount the elastic switch member is closed by the elastic switch member itself to seal the inside of a housing of a security sensor. That is, the elastic switch member is provided with both the function of ensuring sealing for preventing a flood into the housing of the security sensor and the function of an actuating member for detecting tampering.

Solving Means

Specifically, the present invention is premised on a tamper switch structure for detecting removal of a security sensor from a fixed object surface to which the security sensor is fixed, wherein a tamper switch body including a depressible switch actuating member is housed within a housing of the security sensor, and the removal is detected when a state in which the security sensor is fixed to the fixed object surface and the switch actuating member is depressed is changed to a state in which the security sensor is removed from the fixed object surface and the depressed state of the switch actuating member is released. In this tamper switch structure, a tamper opening is formed at a position opposite the switch actuating member in the housing of the security sensor. Furthermore, an elastic switch member is provided that seals the inside of the housing by closing the tamper opening, and that renders the switch actuating member in a depressed state by elastically deforming by receiving a pushing force from the fixed object surface to which the security sensor is fixed, while maintaining the closed state of the tamper opening, in a fixed state of the security sensor.

With this feature, in a state in which the security sensor is fixed to a fixed object surface to which the security sensor is fixed, the elastic switch member elastically deforms by receiving a pushing force from the fixed object surface, and depresses the switch actuating member, while maintaining the closed state of the above-described tamper opening. Thus, the tamper switch body recognizes that the security sensor is fixed to the fixed object surface, and therefore does not transmit the tampering detection signal (trouble signal). Even if this security sensor is installed outside and rainwater or the like pours over it, rainwater or the like will not enter into the housing of the security sensor, since the tamper opening is maintained in a closed state by the elastic switch member. Then, the security sensor has been removed from the fixed object surface in an attempt of illegal intrusion or the like, the pushing force received by the elastic switch member from the fixed object surface to which the security sensor is fixed is released, and the elastic switch member is restored in a shape to which no external force is applied, releasing the depressing of the switch actuating member. Thus, the tamper switch body recognizes that the security sensor has been removed from the fixed object surface to which the security sensor has been fixed, and therefore transmits the tampering detection signal (trouble signal). In this way, in this solving means, the elastic switch member that depresses the switch actuating member by elastically deforming by the pushing force from the fixed object surface to which the security sensor is fixed is mounted in the tamper opening of the housing. Accordingly, it is possible to prevent a flood into the security sensor by rain or the like, while providing the security sensor with the tampering detection function, thus making it possible to realize outdoor installation of the security sensor having the tampering detection function.

A specific configuration of the elastic switch member in this case may include a sealing portion, a pressure-receiving projection portion and an actuating projection portion. The sealing portion is a portion that seals the inside of the housing by contacting an inner surface of the tamper opening to close the tamper opening. The pressure-receiving projection portion is a portion that is integrally formed with the sealing portion and that receives a pushing force from the fixed object surface to which the security sensor is fixed in a fixed state. The actuating projection portion is a portion that is integrally formed with the sealing portion and that applies a pushing force in a depressing direction to the switch actuating member of the tamper switch body through elastic deformation of the sealing portion by the pressure-receiving projection portion receiving a pushing force from the fixed object surface to which the security sensor is fixed in a fixed state. That is, in this elastic switch member, the sealing portion elastically deforms, while sealing the inside of the housing by closing the tamper opening, thereby allowing the pushing force received by the pressure-receiving projection portion from the fixed object surface to which the security sensor is fixed to be acted upon the switch actuating member of the tamper switch body via the actuating projection portion. Accordingly, it is possible to perform a highly reliable tampering detection operation.

An example of the configuration in which the present invention is applied to a security sensor including a housing provided with a first cover and a second cover mounted on the first cover is as follows. First, the present invention is premised on a tamper switch structure for detecting removal of a second cover of a security sensor, wherein a tamper switch body including a depressible switch actuating member is housed within a housing of the security sensor, and the removal is detected when a state in which the second cover is mounted on a first cover constituting the housing of the security sensor and the switch actuating member is depressed is changed to a state in which the second cover is removed from the first cover and the depressed state of the switch actuating member is released. In this tamper switch structure, a tamper opening is formed at a position opposite the switch actuating member in the first cover of the security sensor. Furthermore, an elastic switch member is provided that seals the inside of the housing by closing the tamper opening, and that renders the switch actuating member in a depressed state by elastically deforming by receiving a pushing force from the second cover, while maintaining the closed state of the tamper opening, in a mounted state of the second cover.

In the case of this solving means, in a state in which the second cover is mounted on the first cover, the elastic switch member elastically deforms by receiving a pushing force from the second cover, thereby rendering the switch actuating member in a depressed state, while maintaining the closed state of the above-described tamper opening. Thus, the tamper switch body recognizes that the second cover is mounted on the first cover, and therefore does not transmit the tampering detection signal (trouble signal). Even if this security sensor is installed outside and water enters the gap between the first cover and the second cover because of rainwater or the like pouring over it, rainwater or the like will not enter into the housing (into the first cover) of the security sensor, since the above-described tamper opening is maintained in a closed state by the elastic switch member. Then, when the second cover has been removed from the first cover in an attempt of illegal intrusion or the like, the pushing force received by the elastic switch member from the second cover is released, and the elastic switch member is restored in a shape to which no external force is applied, releasing the depressing of the switch actuating member. Thus, the tamper switch body recognizes that the second cover has been removed from the first cover, and therefore transmits the tampering detection signal (trouble signal). In this way, also with this solving means, it is possible to prevent a flood into the sensor by rain or the like, while providing the security sensor with the tampering detection function, thus making it possible to realize outdoor installation of the security sensor having the tampering detection function.

In a specific configuration of the elastic switch member in this case, the elastic switch member may be connected with the switch actuating member of the tamper switch body via a connection pin, and may include a sealing portion and a pressure-receiving projection portion. The sealing portion is a portion that seals the inside of the housing by contacting an inner surface of the tamper opening to close the tamper opening. The pressure-receiving projection portion is a portion that is integrally formed with the sealing portion and that receives a pushing force from the second cover in a mounted state of the second cover. The back surface of the pressure-receiving projection portion applies an operational force to the connection pin through elastic deformation of the sealing portion by the pressure-receiving projection portion receiving a pushing force from the second cover in a mounted state of the second cover, and the connection pin applies a pushing force in a depressing direction to the switch actuating member. That is, even if the distance between the elastic switch member and the switch actuating member is large, the depressing force for deforming the elastic switch member can be acted upon the switch actuating member via the connection pin, thus making it possible to perform a highly reliable tampering detection operation also in this case. Furthermore, it is possible to increase the flexibility of the setting position of the tamper switch body within the housing.

Further, in the case of applying the present invention to a security sensor provided with a plurality of casing members that are combined one another to form the housing, the above-described elastic switch member may be integrally formed with a seal member disposed in an adjacent surface portion where the casing members are in contact with each other. That is, it is possible, with a single member, to achieve a sealed structure for preventing a flood between the casing members and a sealed structure for preventing a flood into the housing by closing the tamper opening, thus reducing the number of parts of the sensor as a whole.

Additionally, a security sensor including the tamper switch structure according to any of the above-described solving means is also within the scope of the technical concept of the present invention. That is, a security sensor including the tamper switch structure according to the present invention may be a security sensor wherein a passive infrared element, a storage battery for supplying power to the passive infrared element, a transmitter for wirelessly transmitting a detection signal when a human body is detected within a monitoring area by the passive infrared element are housed within the housing. Furthermore, the present invention can be applied not only to this wireless security sensor, but also to a wired security sensor to which the power supply wiring is connected.

As described above, according to the present invention, the elastic switch member at a position opposite the switch actuating member of the tamper switch is provided with both the function of ensuring sealing for preventing a flood into the housing and the function of an actuating member for tempering detection. Accordingly, it is possible to prevent a flood into the sensor by rain or the like, while providing the security sensor with the tampering detection function, thus making it possible to realize outdoor installation of the security sensor having the tampering detection function and to improve the usefulness of the outdoor installation type security sensor.

DESCRIPTION OF THE PREFERRED EMBODIMENTS

Hereinafter, an embodiment of the present invention will be described with reference to the accompanying drawings. In this embodiment, a case will be described where the present invention is applied to a security PIR sensor serving as a starting switch of a security alarm device.

Overall Configuration of PIR Sensor

Figure 1:
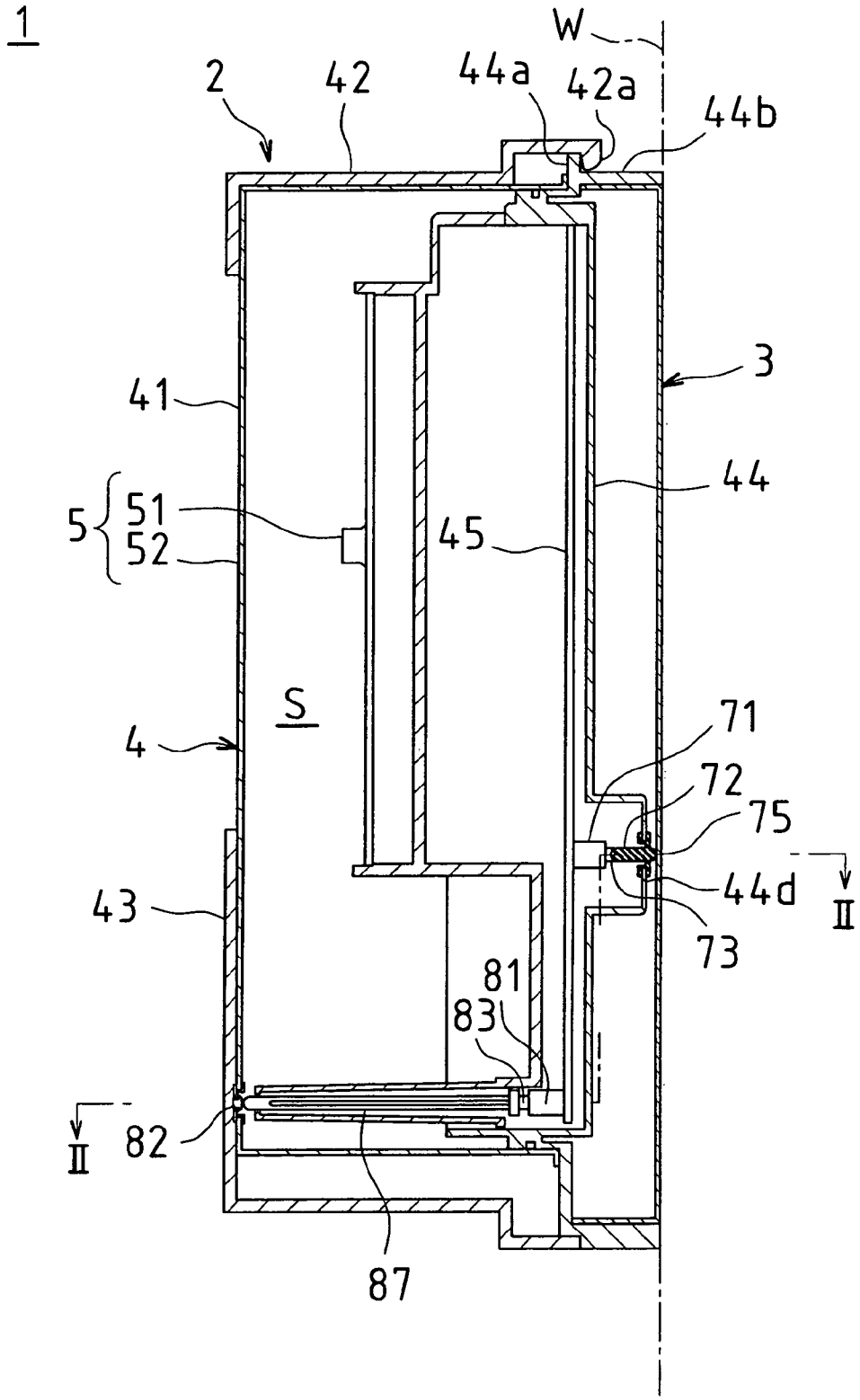
FIG. 1 is a vertical cross-sectional view schematically showing the internal configuration of a PIR sensor according to an embodiment.
Figure 2:
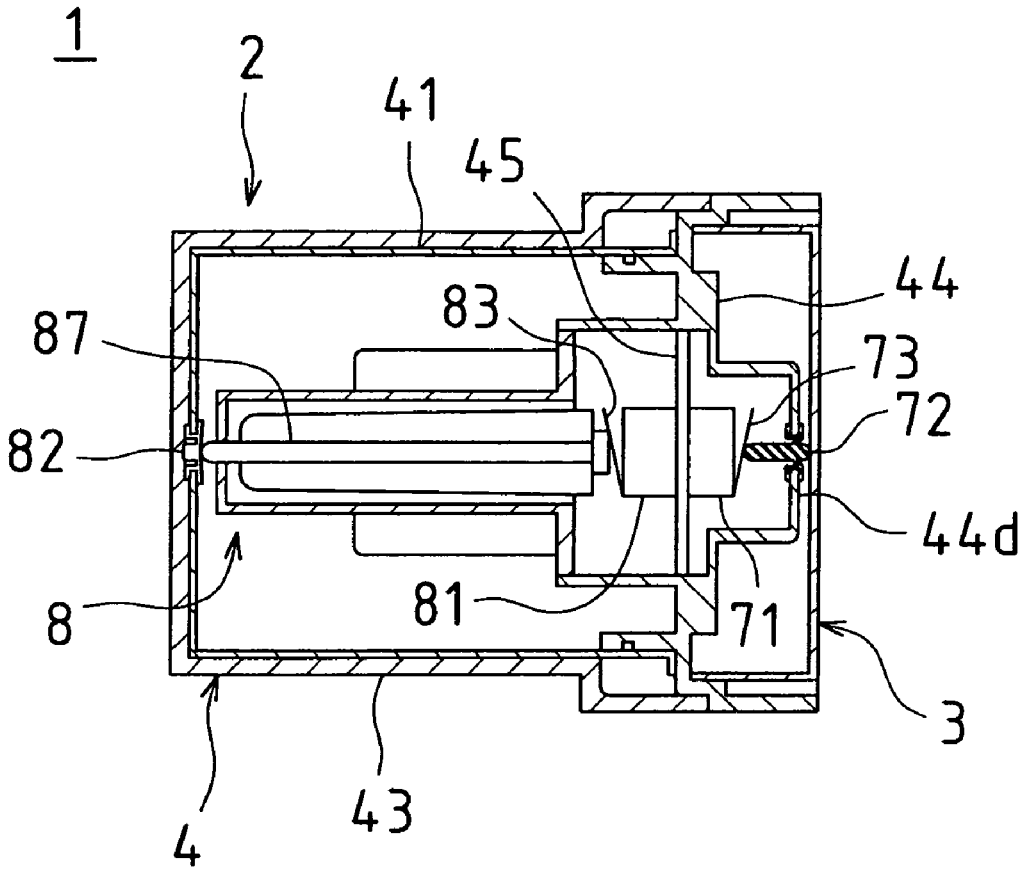
FIG. 2 is a cross-sectional view of the PIR sensor, taken at the position corresponding to the line II—II in FIG. 1.

FIG. 1 is a vertical cross-sectional view schematically showing the internal configuration of a PIR sensor 1 according to this embodiment. FIG. 2 is a cross-sectional view of the PIR sensor 1, taken at the position corresponding to the line II—II in FIG. 1.

As shown in FIGS. 1 and 2, the PIR sensor 1 of this embodiment is mounted on an outer wall surface W (see the dash-dotted line in FIG. 1) of a house or an office building, and includes a sensor body 2 and a mounting plate 3. That is, after the mounting plate 3 is fixed to the above-described outer wall surface W, the sensor body 2 is fixed to the mounting plate 3, and thereby the PIR sensor is fixed to the outer wall surface W.

In the configuration of the above-described sensor body 2, a sensor unit 5 made up of a light-receiving element 51 and an optical system 52 is housed inside a housing 4. The light-receiving element 51 is constituted by an infrared detection element (passive infrared element) such as a pyroelectric element, and outputs an electric signal proportional to the amount of change of incident infrared energy. On the other hand, the optical system 52 uses a Fresnel lens integrated with a main cover 41, which will be described later, in this embodiment. There is no limitation to this, and it is possible to use, for example, a prism or a mirror, so long as infrared radiation energy can be gathered and made incident on the light-receiving element 51.

The electric signal that is output from the light-receiving element 51 of the above-described sensor unit 5 is constantly monitored for its signal intensity, that is, the signal intensity corresponding to the amount of change of infrared light beams. Then, a high-level detection signal is output when the signal level of the electric signal exceeds a predetermined level, and the PIR sensor 1 of this embodiment outputs a human body detection signal when the signal level of the electric signal that is output from the light-receiving element 51 exceeds a predetermined level. In response to output of this human body detection signal, an alarm generating device (not shown) such as an illumination lamp, a buzzer or a siren is actuated.

The above-described housing 4 is configured by integrally assembling the main cover 41, which is herein referred to as a first cover, an upper cover 42, a lower cover 43, which is herein referred to as a second cover, and a base plate 44. They are each molded from resin.

A printed board 45 is mounted on the front surface (the left-side surface in FIG. 1) of the above-described base plate 44. Furthermore, screw holes (not shown) for screwing the base plate 44 to the above-described mounting plate 3 are formed in the lower end portion of the base plate 44.

The main cover 41 is made of, for example, polyethylene, and formed in the shape of a box one side (the right side in FIG. 1) of which is open, and its entire peripheral edge portion, which is the end edge on the opening side, is placed on the base plate 44, forming a substantially sealed, internal housing space S with the base plate 44.

The upper cover 42 is a member made of, for example, an ABS resin for increasing the rigidity of the upper portion of PIR sensor 1 by covering the upper end portion of the above-described main cover 41. A hook 42*a* engageable with a bracket 44*a* formed on the upper end surface of the base plate 44 is formed at the upper end of the upper cover 42. This hook 42*a* is engaged with the bracket 44*a* of the base plate 44, and the upper cover 42 is mounted on the base plate 44 by means such as screwing, thus integrally assembling the upper cover 42 with the base plate 44 and the main cover 41.

Similarly to the above-described upper cover 42, the lower cover 43 is a member made of, for example, ABS resin for increasing the rigidity of the lower portion of the PIR sensor 1 by covering the lower end portion of the above-described main cover 41. The lower end portion of the lower cover 43 is mounted on the base plate 44 by means such as screwing, thus integrally assembling the lower cover 43 with the base plate 44 and the main cover 41.

Furthermore, at the time of mounting the sensor body 2 of the PIR sensor 1 of this embodiment on the mounting plate 3, the above-described base plate 44 is mounted on the mounting plate 3. That is, the base plate 44 is mounted on the mounting plate 3 by engaging an engaging projection 44*b* at the upper portion of the base plate 44 with the upper end portion of the mounting plate 3, while screwing fixation screws (not shown) from the lower portion of the base plate 44.

The PIR sensor 1 configured as described above is installed on the outer wall surface W of a house or an office building at a height level substantially corresponding to the waist of an adult. Then, as the human body detection operation, it outputs the human body detection signal only when the signal level of the electric signal from the light-receiving element 51 exceeds the detection level, thereby enabling detection of a human body. Furthermore, the PIR sensor 1 carries out wireless transmission, and includes a storage battery (dry battery) (not shown) for power supply and an antenna attached to a transmitter for wirelessly transmitting the above-described human body detection signal or a tampering detection signal (trouble signal), which will be described later, in the housing 4, without being connected to the power supply wiring or the human body detection signal-transmission wiring.

Tamper Switch Structure

Next, a tamper switch structure that is a characterizing portion of this embodiment will be described. The PIR sensor 1 of this embodiment includes a wall tamper switch 7 and a cover tamper switch 8. Each of these will be described below.

(Wall Tamper Switch 7)

The wall tamper switch 7 is a switch for detecting that the sensor body 2 has been removed from the mounting plate 3 (that tampering has been carried out) in non-alert operation, for example.

The wall tamper switch 7 includes a tamper switch body 71 and an elastic switch member 72 made of rubber.

Figure 4:
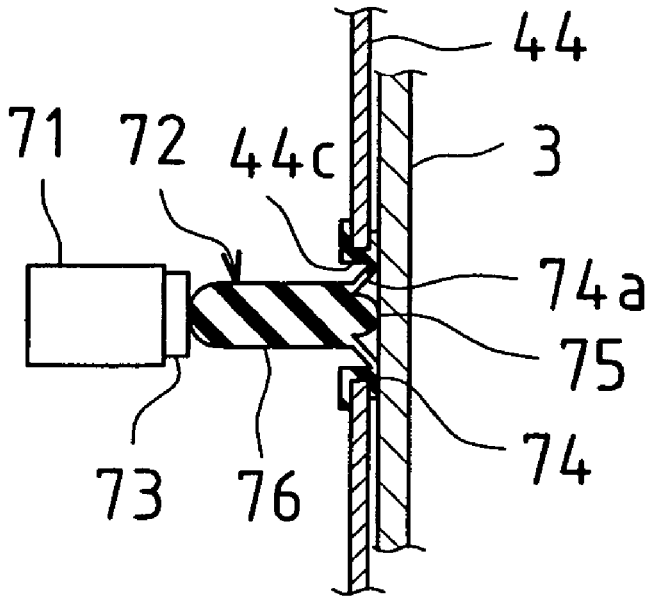
FIGS. 4A and 4B are diagrams showing the actuated state of the wall tamper switch.
Figure 4:
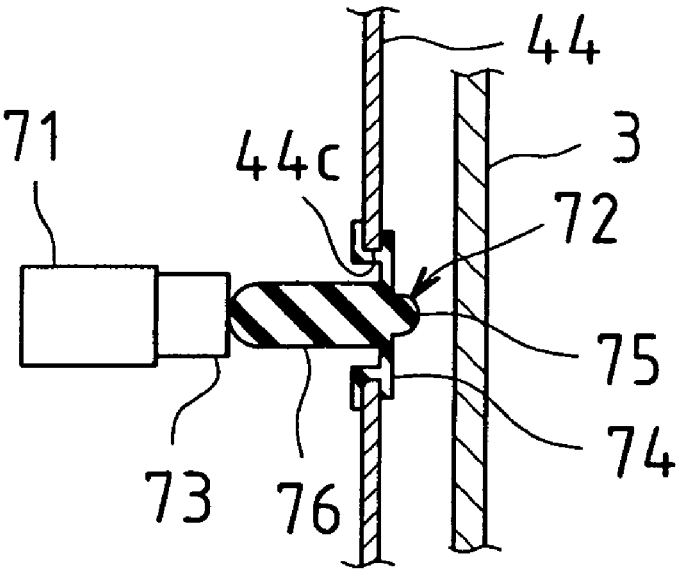

The tamper switch body 71 is mounted on the back surface (the right-side surface in FIG. 1) of the above-described printed board 45 inside the sensor body 2, and includes a hinge-type, depressible switch actuating member 73. In a state in which the switch actuating member 73 is depressed, the tamper switch body 71 will not transmit the tampering detection signal (trouble signal), and the tamper switch body 71 transmits the tampering detection signal when the depressing of the switch actuating member 73 is released, Then, the above-described base plate 44 has a recessed portion 44*d*, which is recessed (bent) toward the back surface side of the sensor body 2 (the side facing the mounting plate 3, and the right side in FIG. 1), formed at its portion opposite the switch actuating member 73, and a relatively small, circular tamper opening 44*c* (see FIG. 4) is formed at the center of the recessed portion 44*d*. Then, the above-described elastic switch member 72 is mounted in the tamper opening 44*c*.

Figure 3:
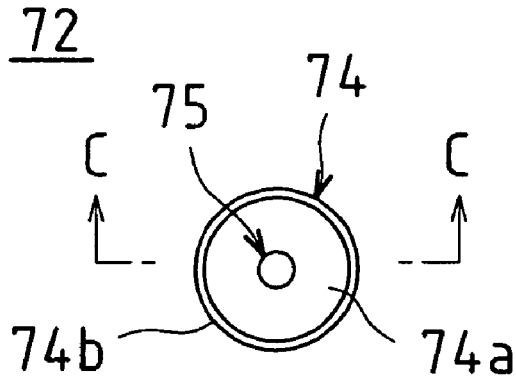
FIG. 3A is a top view of an elastic switch member included in a wall tamper switch.
FIG. 3B is a side view thereof.
FIG. 3C is a cross-sectional view taken along the line C—C in FIG. 3A.
Figure 3:
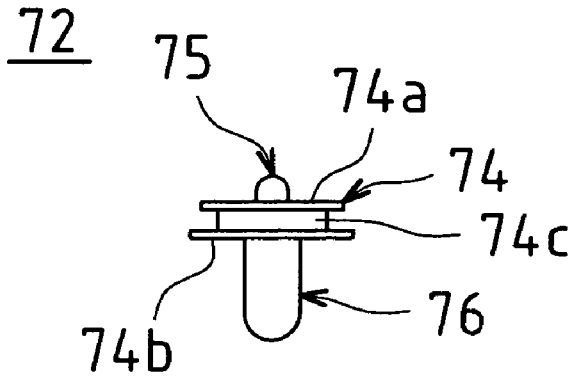
Figure 3:
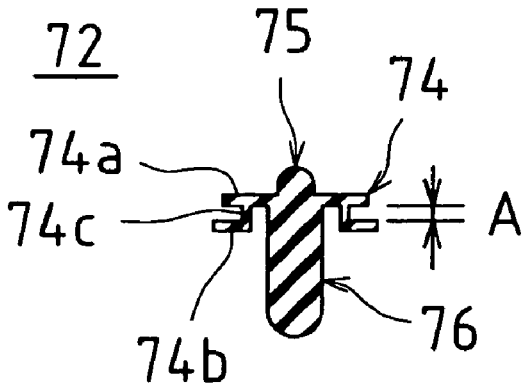

In the following, the shape of the elastic switch member 72 will be described. FIGS. 3A to 3C show the elastic switch member 72. FIG. 3A is a top view of the elastic switch member 72, FIG. 3B is a side view thereof, and FIG. 3C is a cross-sectional view taken along the line C—C in FIG. 3A. As shown in FIGS. 3A to 3C, the elastic switch member 72 includes a sealing portion 74, a pressure-receiving projection portion 75 and an actuating projection portion 76.

The sealing portion 74 is a portion contacting the edge portion of the above-described tamper opening 44*c* so as to close the tamper opening 44*c*, thereby sealing the inside of the housing 4. That is, when the sealing portion 74 is mounted on the edge portion of the tamper opening 44*c*, the sealing portion 74 includes an outer surface ring portion 74*a* abutting the entire perimeter of the edge portion of the tamper opening 44*c* on the outer surface (the right-side surface in FIG. 1) of the base plate 44, and an inner surface ring portion 74*b* abutting the entire perimeter of the edge portion of the tamper opening 44*c* on the inner surface of the base plate 44 (the left-side surface in FIG. 1). Furthermore, the inner surface ring portion 74*b* is formed to have an outer diameter size slightly larger than the outer diameter size of the outer surface ring portion 74*a*, and the inner peripheral portion of the inner surface ring portion 74*b* is connected with the lower surface of the outer surface ring portion 74*a* by a flat cylindrical connecting portion 74*c*. Further, the height dimension of the connecting portion 74*c* (the dimension A in FIG. 3C) is substantially equal to the thickness of the base plate 44, and the outer surface ring portion 74*a* and the inner surface ring portion 74*b* sandwiches the base plate 44, thereby abutting the respective surfaces of the base plate 44 without any gap.

The above-described pressure-receiving projection portion 75 is a portion that is integrally formed with the above-described sealing portion 74 and that receives a pushing force from the surface of the above-described mounting plate 3, which is the fixed object surface to which the PIR sensor 1 is fixed, in the fixed state of the PIR sensor 1. That is, the pressure-receiving projection portion 75 is a projection formed at the center of the surface of the outer surface ring portion 74*a* of the above-described sealing portion 74, and, in the fixed state of the PIR sensor 1, the apex of the pressure-receiving projection portion 75 abuts the mounting plate 3 and receives the pushing force from this mounting plate 3, thus elastically deforming the outer surface ring portion 74*a* in the direction toward the inside of the sensor.

The actuating projection portion 76 is a portion that is integrally formed with the above-described sealing portion 74 and that applies a pushing force in a depressing direction to the switch actuating member 73 of the tamper switch body 71 through elastic deformation of the sealing portion 74 by the pressure-receiving projection portion 75 receiving the pushing force from the mounting plate 3 in the fixed state of the PIR sensor 1. That is to say, the actuating projection portion 76 is a projection projected from the center of the back surface of the outer surface ring portion 74*a* of the sealing portion 74, and its apex is set to a position projecting beyond the inner surface ring portion 74*b* of the sealing portion 74 (the lower-side position in FIG. 3C).

FIGS. 4A and 4B are diagrams showing the actuated state of the wall tamper switch 7. FIG. 4A shows a state in which the PIR sensor 1 is fixed to the outer wall surface W. In this state, the pressure-receiving projection portion 75 receives the pushing force from the mounting plate 3, and the actuating projection portion 76 applies a pushing force in a depressing direction to the switch actuating member 73 of the tamper switch body 71 through elastic deformation of the outer surface ring portion 74*a* of the above-described sealing portion 74. Thus, the tamper switch body 71 recognizes that the PIR sensor 1 is fixed to the outer wall surface W, and therefore does not transmit the tampering detection signal (trouble signal). Furthermore, even if the PIR sensor 1 is installed outside and rainwater or the like pours over it, the tamper opening 44*c* is maintained in a closed state for preventing a flood by rain into the housing 4 by the elastic switch member 72. Accordingly, rainwater or the like will not enter into the housing 4, making it possible to also prevent failure of the sensor that could have been caused by a flood of water.

FIG. 4B shows a state in which the PIR sensor 1 is removed from the mounting plate 3 (a state in which tampering has been carried out). In this sate, the pushing force received by the elastic switch member 72 from the mounting plate 3 is released, the elastic switch member 72 is restored in a shape to which no external force is applied, releasing the depressing of the switch actuating member 73. Thus, the tamper switch body 71 recognizes that the PIR sensor 1 has been removed from the mounting plate 3, and therefore transmits the tampering detection signal (trouble signal).

(Cover Tamper Switch 8)

Next, the cover tamper switch 8 will be described with reference to FIGS. 5A to 5C and FIGS. 6A and 6B. The cover tamper switch 8 differs from the above-described wall tamper switch 7 in the shape of the elastic switch member 82, and also is different from the wall tamper switch 7 in that a connection pin 87 is disposed between the elastic switch member 82 and the switch actuating member 83 of the tamper switch body 81. Therefore, only the points of difference with the wall tamper switch 7 will be described here.

The cover tamper switch 8 is a switch for detecting that the lower cover 43 has been removed from the main cover 41 (that tempering has been carried out) in non-alert operation, for example.

The cover tamper switch 8 includes a tamper switch body 81, an elastic switch member 82 made of rubber and a connection pin 87.

The tamper switch body 81 is mounted on the front surface (the left-side surface in FIG. 1) on the above-described printed board 45 inside the sensor body 2, and includes a depressible switch actuating member 83. In a state in which the switch actuating member 83 is depressed, the tamper switch body 81 will not transmit the tampering detection signal (trouble signal), and the tamper switch body 81 transmits the tampering detection signal when the depressing of the switch actuating member 83 is released.

Then, the above-described main cover 41 has a relatively small circular tamper opening 41*a* (see FIG. 6) formed at its portion opposite the switch actuating member 83. Then, the above-described elastic switch member 82 is mounted in the tamper opening 41*a*.

Figure 5:
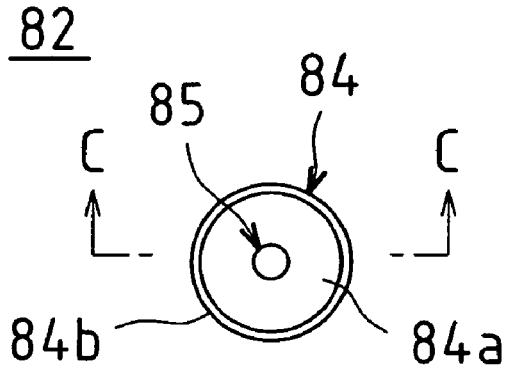
FIG. 5A is a top view of an elastic switch member included in a cover tamper switch.
FIG. 5B is a side view thereof.
FIG. 5C is a cross-sectional view taken along the line C—C in FIG. 5A.
Figure 5:
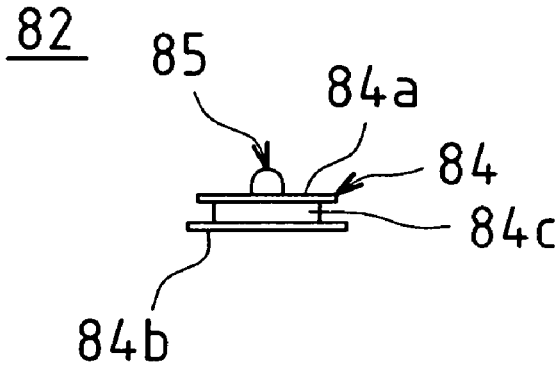
Figure 5:
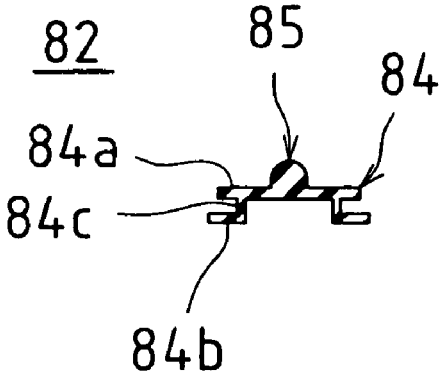
Figure 6:
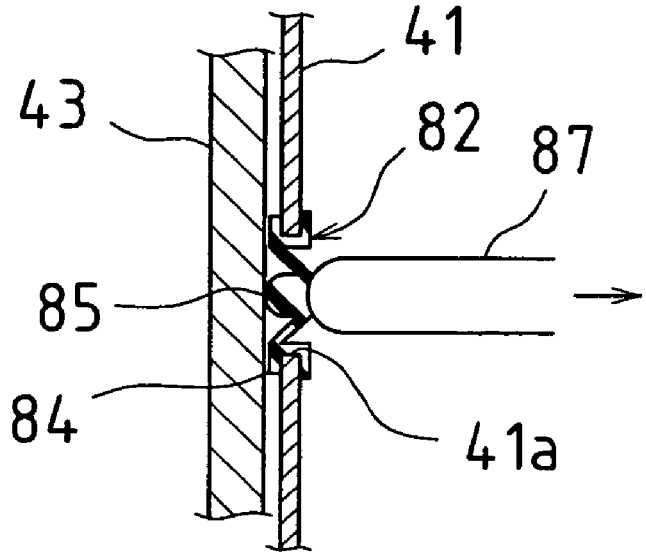
FIGS. 6A and 6B are diagrams showing the actuated state of the cover tamper switch.
Figure 6:
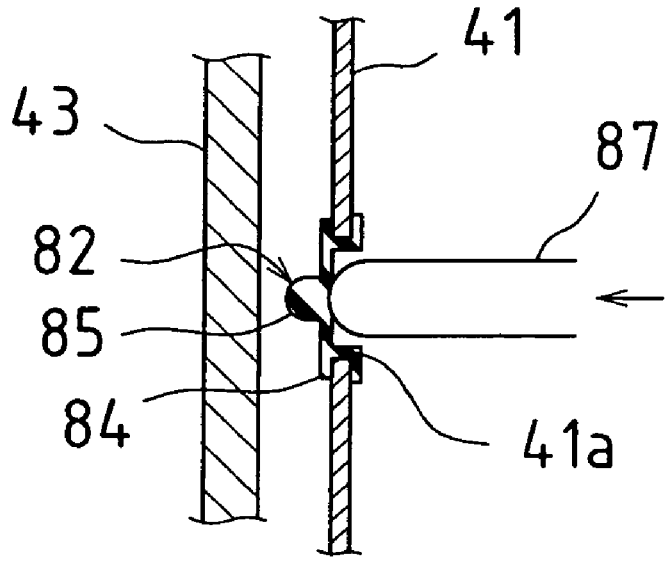

FIG. 5A to 5C show the elastic switch member 82. FIG. 5A is a top view of the elastic switch member 82, FIG. 5B is a side view thereof, and FIG. 5C is a cross-sectional view taken along the line C—C in FIG. 5A. As shown in FIGS. 5A to 5C, the elastic switch member 82 includes a sealing portion 84 and a pressure-receiving projection portion 85. The shapes of the sealing portion 84 and the pressure-receiving projection portion 85 are identical to those of the elastic switch member 72 included in the above-described wall tamper switch 7, the description has been omitted here. It should be noted that in the case of the cover tamper switch 8 of this embodiment, the sealing portion 84 contacts the edge portion of the tamper opening 41*a* formed in the main cover 41 so as to close the tamper opening 41*a*, thereby sealing the inside of the housing 4. Furthermore, the pressure-receiving projection portion 85 receives a pushing force from the lower cover 43 in a state in which the lower cover 43 is mounted on the main cover 41. Further, the elastic switch member 82 of this embodiment is different from that of the above-described wall tamper switch 7 in that it does no include the actuating projection portion.

The proximal end of the above-described connection pin 87 is integrated with or abuts the switch actuating member 83 of the tamper switch body 81, whereas its distal end is inserted into a recess formed between the outer surface ring portion 84*a* and the connecting portion 84*c* of the elastic switch member 82, and abuts the lower surface of the outer surface ring portion 84*a*. That is, this connection pin 87 moves forward and backward in the axial direction with elastic deformation of the outer surface ring portion 84*a* by the pushing force from the lower cover 43, thereby performing the depressing operation and the depression releasing operation of the switch actuating member 83 of the tamper switch body 81.

FIGS. 6A and 6B are diagrams showing the actuated state of the cover tamper switch 8. FIG. 6A shows a state in which the lower cover 43 is mounted on the main cover 41. In this state, the pressure-receiving projection portion 85 receives a pushing force from the lower cover 43, and the connection pin 87 applies a pushing force in a depressing direction to the switch actuating member 83 of the tamper switch body 81 through elastic deformation of the outer surface ring portion 84*a* of the above-described sealing portion 84. Thus, the tamper switch body 81 recognizes that the lower cover 43 is mounted on the main cover 41, and therefore does not transmit the tampering detection signal (trouble signal). Furthermore, even if this PIR sensor 1 is installed outside and water enters into the gap between the lower cover 43 and the main cover 41 because of rainwater or the like pouring over it, the above-described tamper opening 41*a* is maintained in a closed state for preventing a flood into the sensor by rain into the housing 4 by the elastic switch member 82. Accordingly, rainwater or the like will not enter into the housing 4 (into the main cover 41), making it possible to also prevent failure of the sensor that could have been caused by a flood.

FIG. 6B shows a sate in which the lower cover 43 has been removed from the main cover 41 (a state in which tampering has been carried out). In this state, the pushing force received by the elastic switch member 82 from the lower cover 43 is released, and the elastic switch member 82 is restored in a shape to which no external force is applied, releasing the depressing of the switch actuating member 83. Thus, the tamper switch body 81 recognizes that the lower cover 43 has been removed from the main cover 41, and therefore transmits the tampering detection signal (trouble signal).

As has been set forth above, with the above-described tamper switch 7 and the cover tamper switch 8 according to this embodiment, it is possible to provide the PIR sensor 1 with the tampering detection function, while preventing a flood into the sensor by rain or the like, thus making it possible to realize outside installation of the PIR sensor 1 having the tampering detection function.

Modified Example

Next, a modified example of the elastic switch member 72 included in the wall tamper switch 7 will be described. The elastic switch member 72 according to this example is characterized in that it is integrally formed with a seal member 9 made of rubber for ensuring sealing of the portion where the entire peripheral edge portion, which is the end edge on the opening side, of the main cover 41 is in contact with the base plate 44, as shown in FIGS. 7 and 8.

Figure 7:
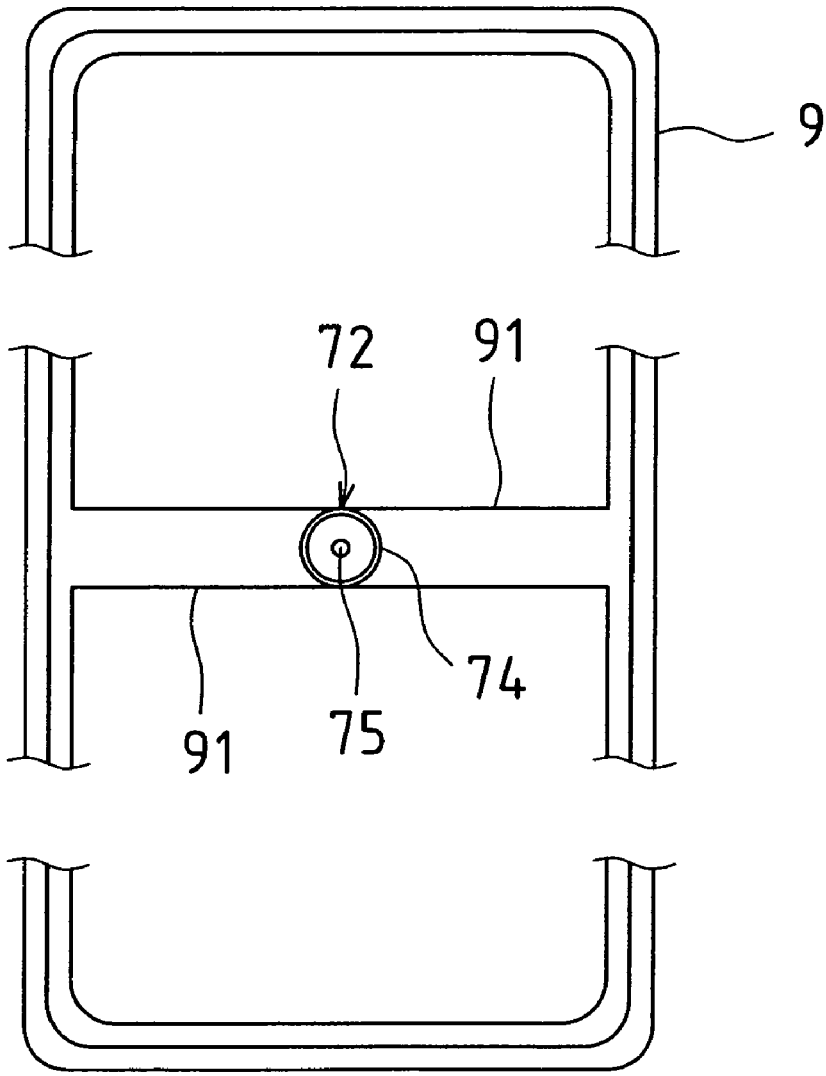
FIG. 7 is a front view showing an elastic switch member and a seal member according to a modified example.
Figure 8:
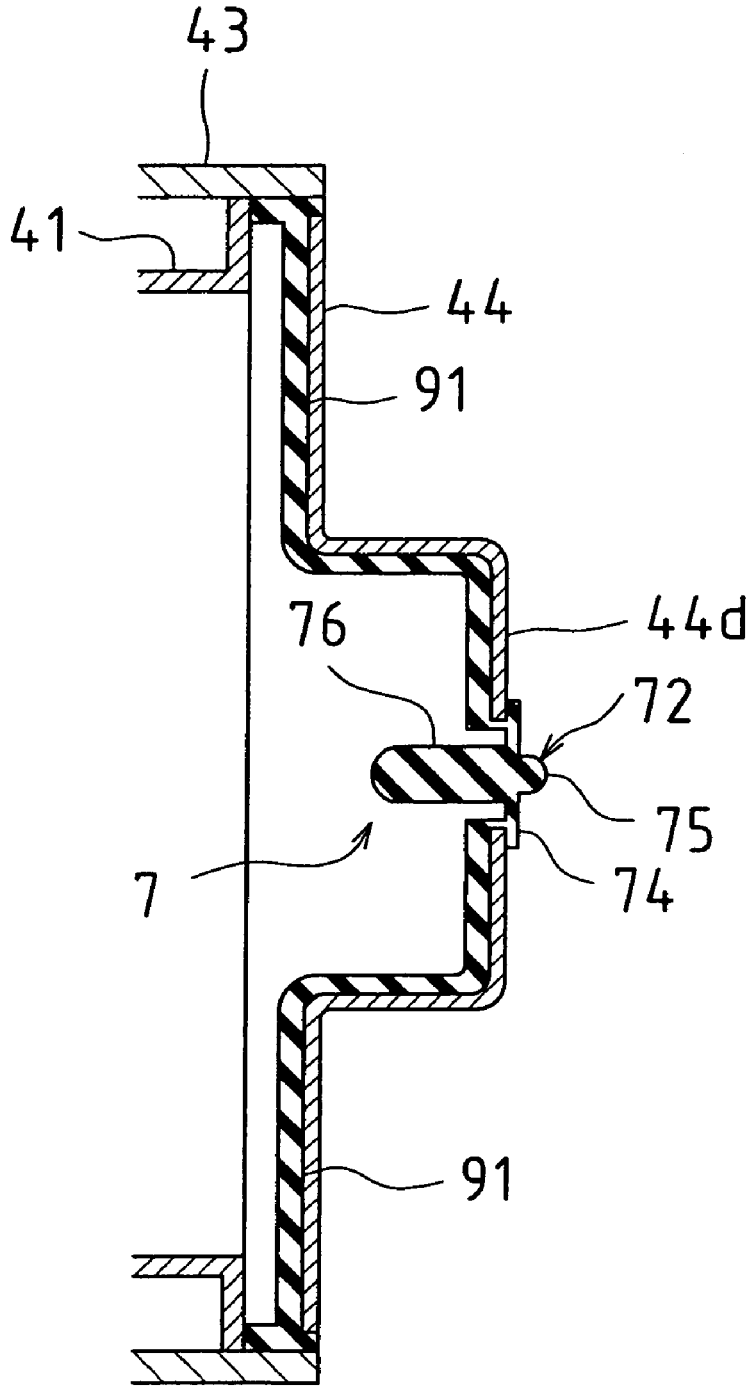
FIG. 8 is a cross-sectional view showing a portion of a PIR sensor, showing how the elastic switch member and the seal member according to the modified example are mounted

FIG. 7 is a front view of the elastic switch member 72 and the seal member 9 that are integrated, and FIG. 8 is an enlarged cross-sectional view showing a portion of the PIR sensor 1, showing how they are mounted (an enlarged view of the peripheral portion of the wall tamper switch 7 at the cross-section corresponding to FIG. 2). As shown in FIGS. 7 and 8, the inner surface ring portion (corresponding to the inner surface ring portion denoted by reference numeral 74*b* shown in FIG. 3) is integrally connected with the inner edge of the frame-shaped seal member 9 of the elastic switch member 72 by bridge members 91. The bridge member 91 has a shape extending horizontally from the inner edge of the seal member 9 so as to follow the shape of the inner surface of the above-described base plate 44.

By integrating the elastic switch member 72 and the seal member in this way, it is possible, with a single member, to achieve a sealed structure for preventing a flood between the structural components of the housing 4 and a sealed structure for preventing a flood into the housing 4 by closing the tamper opening 44*c*, thus reducing the number of parts of the sensor as a whole.

In addition, as a modified example of the cover tamper switch in which the main cover (inner cover) 41 and the lower cover 43 are molded in one piece, it is also possible to employ a configuration that allows the detection of removal of this cover.

Other Embodiments

In the above-described embodiment, a case was described where the present invention is applied to the security PIR sensor 1, but the present invention can be applied to various sensors (e.g., an AIR sensor) that require the tampering detection function. Furthermore, the present invention is not limited to sensors of the outdoor installation type, and can be applied to sensors installed at locations such as a bathroom, in which there is the possibility that water may pour over the sensors. Furthermore, the present invention is not limited to wireless security sensors that do not require the power supply wiring, and can be applied to security sensors of the type to which the power supply wiring is connected (wired security sensors).

It should be noted that the present invention may be embodied in other various forms without departing from its spirit or essential characteristics. Accordingly, the described embodiments are to be considered in all respects only as illustrative and not restrictive. The scope of the invention is indicated by the appended claims, and by no means restricted to the foregoing description. Furthermore, all changes or modifications which come within the range of equivalency of the claims are to be embraced within the scope of the invention.

What is claimed is:

1. A tamper switch structure for detecting removal of a security sensor from a fixed object surface to which the security sensor is fixed, wherein a tamper switch body comprising a depressible switch actuating member is housed within a housing of the security sensor, and the removal is detected when a state in which the security sensor is fixed to the fixed object surface and the switch actuating member is depressed is changed to a state in which the security sensor is removed from the fixed object surface and the depressed state of the switch actuating member is released;

wherein a tamper opening is formed at a position opposite the switch actuating member in the housing of the security sensor, and wherein an elastic switch member is provided that seals the inside of the housing by closing the tamper opening, and that renders the switch actuating member in a depressed state by elastically deforming by receiving a pushing force from the fixed object surface to which the security sensor is fixed, while maintaining the closed state of the tamper opening, in a fixed state of the security sensor.

2. The tamper switch structure according to claim 1, wherein the elastic switch member comprises:

a sealing portion that seals the inside of the housing by contacting an inner surface of the tamper opening to close the tamper opening;

a pressure-receiving projection portion that is integrally formed with the sealing portion and that receives a pushing force from the fixed object surface to which the security sensor is fixed in a fixed state; and an actuating projection portion that is integrally formed with the sealing portion and that applies a pushing force in a depressing direction to the switch actuating member of the tamper switch body through elastic deformation of the sealing portion by the pressure-receiving projection portion receiving a pushing force from the fixed object surface to which the security sensor is fixed in a fixed state.

3. The tamper switch structure according to claim 1, wherein the security sensor comprises a plurality of casing members that are combined one another to form the housing, and wherein the elastic switch member is integrally formed with a seal member disposed in an adjacent surface portion where the casing members are in contact with each other.

4. A security sensor comprising the tamper switch structure according to claim 1, wherein a passive infrared element, a storage battery for supplying a power to the passive infrared element, a transmitter for wirelessly transmitting a detection signal when a human body is detected within a monitoring area by the passive infrared element are housed within the housing.

5. The tamper switch structure according to claim 2, wherein the security sensor comprises a plurality of casing members that are combined one another to form the housing, and wherein the elastic switch member is integrally formed with a seal member disposed in an adjacent surface portion where the casing members are in contact with each other.

6. A security sensor comprising the tamper switch structure according to any claim 2, wherein a passive infrared element, a storage battery for supplying a power to the passive infrared element, a transmitter for wirelessly transmitting a detection signal when a human body is detected within a monitoring area by the passive infrared element are housed within the housing.

7. A security sensor comprising the tamper switch structure according to claim 3, wherein a passive infrared element, a storage battery for supplying a power to the passive infrared element, a transmitter for wirelessly transmitting a detection signal when a human body is detected within a monitoring area by the passive infrared element are housed within the housing.

8. A tamper switch structure for detecting removal of a second cover of a security sensor, wherein a tamper switch body comprising a depressible switch actuating member is housed within a housing of the security sensor, and the removal is detected when a state in which the second cover is mounted on a first cover constituting the housing of the security sensor and the switch actuating member is depressed is changed to a state in which the second cover is removed from the first cover and the depressed state of the switch actuating member is released;

wherein a tamper opening is formed at a position opposite the switch actuating member in the first cover of the security sensor, and wherein an elastic switch member is provided that seals the inside of the housing by closing the tamper opening, and that renders the switch actuating member in a depressed state by elastically deforming by receiving a pushing force from the second cover, while maintaining the closed state of the tamper opening, in a mounted state of the second cover.

9. The tamper switch structure according to claim 8, wherein the elastic switch member is connected with the switch actuating member of the tamper switch body via a connection pin, wherein the elastic switch member comprises:

a sealing portion that seals the inside of the housing by contacting an inner surface of the tamper opening to close the tamper opening; and a pressure-receiving projection portion that is integrally formed with the sealing portion and that receives a pushing force from the second cover in a mounted state of the second cover, and wherein the back surface of the pressure-receiving projection portion applies an operational force to the connection pin through elastic deformation of the sealing portion by the pressure-receiving projection portion receiving a pushing force from the second cover in a mounted state of the second cover, and the connection pin applies a pushing force in a depressing direction to the switch actuating member.

10. The tamper switch structure according to claim 8, wherein the security sensor comprises a plurality of casing members that are combined one another to form the housing, and wherein the elastic switch member is integrally formed with a seal member disposed in an adjacent surface portion where the casing members are in contact with each other.

11. The tamper switch structure according to claim 9, wherein the security sensor comprises a plurality of casing members that are combined one another to form the housing, and wherein the elastic switch member is integrally formed with a seal member disposed in an adjacent surface portion where the casing members are in contact with each other.

12. A security sensor comprising the tamper switch structure according to claim 8, wherein a passive infrared element, a storage battery for supplying a power to the passive infrared element, a transmitter for wirelessly transmitting a detection signal when a human body is detected within a monitoring area by the passive infrared element are housed within the housing.

13. A security sensor comprising the tamper switch structure according to claim 9, wherein a passive infrared element, a storage battery for supplying a power to the passive infrared element, a transmitter for wirelessly transmitting a detection signal when a human body is detected within a monitoring area by the passive infrared element are housed within the housing.

* * * * *